United States Patent [19]

Adam

[11] Patent Number: 4,568,901

[45] Date of Patent: Feb. 4, 1986

[54] MAGNETIC FUEL ION MODIFIER

[75] Inventor: Harley J. Adam, Sun City, Calif.

[73] Assignee: A Z Industries, Temecula, Calif.

[21] Appl. No.: 673,672

[22] Filed: Nov. 21, 1984

[51] Int. Cl.[4] ..... H01F 7/02

[52] U.S. Cl. ..... 335/305; 335/306; 210/222

[58] Field of Search ..... 210/222, 695; 335/302, 335/303, 305, 306; 422/186.01, 186.3

[56] References Cited

U.S. PATENT DOCUMENTS

| | | | |
|---|---|---|---|
| 3,228,878 | 1/1966 | Moody | 210/222 X |
| 3,277,415 | 10/1966 | Spodig | 335/306 X |
| 4,367,143 | 1/1983 | Carpenter | 210/222 |

FOREIGN PATENT DOCUMENTS

| | | | |
|---|---|---|---|
| 1301965 | 7/1962 | France | 210/222 |

*Primary Examiner*—George Harris

*Attorney, Agent, or Firm*—Wm. Jacquet Gribble

[57] ABSTRACT

Elongate magnets are arranged about a copper fuel duct with each magnet having a like pole adjacent a flattened or faceted portion of the duct. Each magnet has a flat pole face and bevelled end edges with the bevelled end edges being in contact with the similar end edge of each adjacent magnet to define a tunnel through which the fuel duct runs. The duct is continuous through the magnet tunnel and terminates at each of its ends outside the tunnel in a peripheral bead or other attaching arrangement for coupling of the duct between a fuel source, such as a fuel pump, and a fuel consuming apparatus, such as a carburetor. The ducted fuel is thus exposed to flux lines of the magnets that are arranged about the fuel line to concentrate the lines of force at the fuel duct. The magnets and the fuel duct are held together by a surrounding capsule of non-magnetic material such as polypropylene plastic.

9 Claims, 5 Drawing Figures

TO CARBURETOR
FROM FUEL SUPPLY

MAGNETIC FUEL ION MODIFIER

BACKGROUND OF THE INVENTION

The invention relates to magnetic treatment of hydrocarbon fuels and more particularly to affecting the ionized particles of fuels in hydrocarbons magnetically to achieve cleaner burning in internal combustion engines and better fuel efficiency. A pioneer in this field was Saburo Miyata Moriya of Japan whose Letters U.S. Patent No. 3,278,797 issued Oct. 11, 1966 entitled APPARATUS FOR TREATING FLOWING FLUIDS states the theoretical basis for fuel ionization devices:

"According to a theory propounded by J. D. van der Waals, electrons orbiting around their nuclei have di-poles, which are in a neutral state, However, these di-poles may be affected by magnetic and electric forces which appear to cause deflection. A simple form of hydrocarbon fuel is pentane, $C_5H_{12}$. Hydrogen has a cagelike structure and has a tendency to interlock with other elements, not forming other compounds, but temporarily forming 'pseudo compounds'. When these "pseudo compounds" are influenced by electric and magnetic fields there is a pronounced interlocking with oxygen causing better combustion. It is now believed that the above action takes place in connection with the device of this [sic] invention."

In addition to the above quoted Moriya patent, the following U.S. Letters patents form a part of the literature concerned with the field of the invention:

| | | | |
|---|---|---|---|
| 3,170,871 | 2-23-65 | Miyata Moriya | MAGNETIC FILTER |
| 3,206,657 | 9-14-65 | Miyata Moriya | MAGNET ASSEMBLY FOR FILTERING |
| 3,264,509 | 8-2-66 | Miyata Moriya | DEVICE FOR TREATING FLOWING FLUIDS |
| 3,278,797 | 10-11-66 | Miyata Moriya | APPARATUS FOR TREATING FLOWING FLUIDS |
| 3,349,354 | 10-24-67 | Miyata | MEANS FOR IMPOSING ELECTRIC & MAGNETIC FIELDS ON F. FLUIDS |
| 3,614,691 | 10-19-71 | Miyata | DEVICE FOR TREATING HYDROCARBON FUEL |
| 3,830,621 | 8-20-74 | Miller | PROCESS & APPARATUS FOR EFFECTING EFFICIENT COMBUSTION |

The instant invention distinguishes patentably over any of the prior patents set forth in the unique arrangement of the magnets with respect to the unitary fuel duct which has no leak problems, in the close association of the magnets to the faceted duct to facilitate flux flow without fringing fields so that sufficient impingement upon the fuel can be made to eliminate the need to supply secondary electric force in order to achieve the interlocking with oxygen that makes for superior fuel performance in both gasoline and diesel engines.

SUMMARY OF THE INVENTION

The invention contemplates a liquid fuel ion modifier to be connected between a fuel supply and a fuel using device so that the fuel conduits from the supply and the using device are connectable to opposite ends of the inventive apparatus. The fuel ion modifier may comprise a continuous fuel delivery duct with conduit attachment means at opposite ends and an intermediate duct portion with a plurality of substantially flat or planar facets. Adjacent each facet a bar magnet pole is fixed so that there are an equal number of magnets and duct facets. The magnet poles adjacent the duct are of like polarity and each magnet extends along the duct a similar distance. The magnets are elongate and shaped so a pole face terminates at each long edge in a bevelled surface which abuts the like bevel of each adjacent magnet to define an elongate magnet "tunnel" surrounding the delivery duct intermediate portion. A capsule of a non-magnetic material such as polypropylene is molded around the duct and magnets to secure their relative positions and to form a housing with solid outer surfaces. The duct is preferably a single continuous length of copper tubing adapted to each end to receive conduit leading to fuel supply and carburetor or fuel injector so that the modifier of the invention is leakproof.

The design of the magnets and fuel delivery duct adapts to units of many sizes and the outer configuration of the molded housing may be adapted to the particular usage, such as cylindrical, prismatic or other moldable shape.

The apparatus of the invention has been thoroughly tested on vehicles powered by gasoline and diesel engines. usually mounted between the fuel pump and the fuel injector. In all tests over many miles of varying road conditions and bench tests, use of the invention has shown improved fuel milage, better engine performance and cleaner exhaust emmissions. Fuel consumption savings of up to fifteen percent have been achieved in gasoline truck engine performance and performance of like magnitude noted in all tests.

These and other advantages of the invention are apparent in the following detailed description and drawing in which the invention is disclosed by preferred embodiments.

DESCRIPTION OF THE PREFERRED EMBODIMENTS

Figures 1, 2, 3, 4, 5:
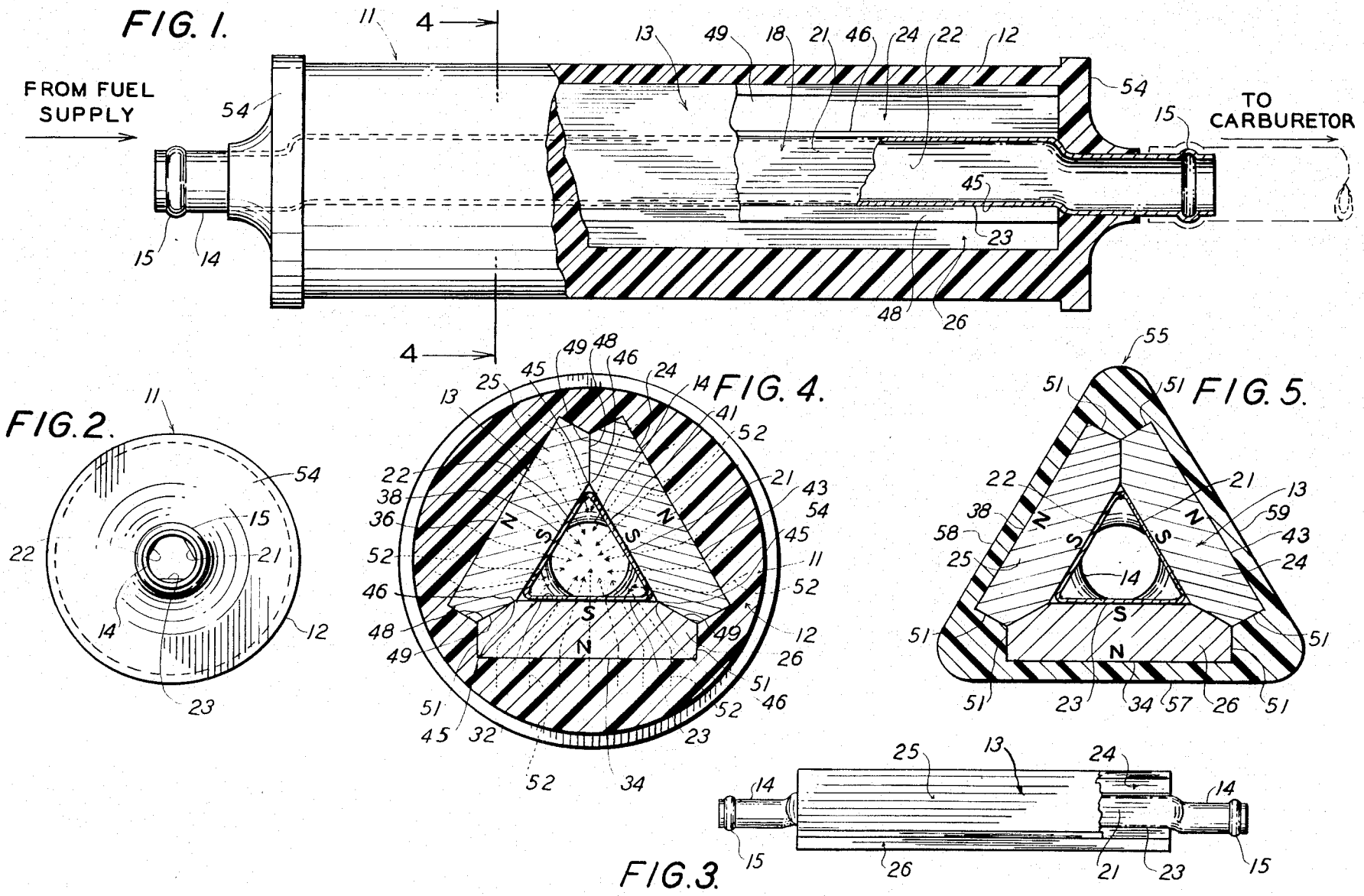
FIG. 1 is a side elevational view, partly broken away, of a preferred embodiment of the invention in a cylindrical casing.
FIG. 2 is a left end elevational view thereof.
FIG. 3 is a side elevational view, partly broken away, of the delivery duct and magnets sub-assembly of the embodiment of FIG. 1.
FIG. 4 is a transverse sectional elevational view taken along line 4—4 of FIG. 1.
FIG. 5 is a transverse sectional elevational view similar to FIG. 4, of an alternate embodiment of the invention.

In various figures like reference numbers are used to identify like elements.

FIGS. 1 through 4 illustrate a liquid fuel ion modifier 11 that has a molded polypropylene casing 12 about a duct and magnet sub-assembly 13. The sub-assembly is shown in FIG. 3 and comprises an elongate tubular duct 14 terminating at each end in annular beads 15 adapted for connection to fuel lines such as the conduit 16 shown in broken lines in FIG. 1 and extending to the carburetor or other fuel injection device of the engine. While annular beads are shown as one connection means, to be used in conjunction with circular clamps, the invention does not preclude the use of threaded connectors or other conventional types of conduit joining means.

The tubular duct 14 is preferably of copper or other flux transparent material other than ferrous products. Intermediate the duct length is an intermediate duct portion 18 which may be prismatic in configuration, as best seen in FIG. 4. The intermediate duct portion has a plurality of outer faces 21, 22, 23 each of which is a flattened segment of the tubular duct. The fuel duct 14 is continuous and extends outwardly beyond the casing 12 so that there is no potential for leakage through the fuel ion modifier.

The sub-assembly 13 also includes three similar bar magnets 24, 25 and 26 fixed in place about the tubular duct 14 adjacent a pole face of the magnet. As can be seen from FIG. 4, each magnet has a planar pole face "S" adjacent the tubular facet and a planar pole magnet face "N" removed or spaced from the tubular facet. For instance, bottom magnet 26 has an adjacent pole 32 and a remote pole 34, while left magnet 25 has an adjacent pole 36 and a remote pole 38. Similarly, right magnet 24, as viewed in FIG. 4, has an adjacent pole 41 and a remote pole 43. Each pole face is bordered by an elongate edge 45, 46 on each long side, defined in part by an edge bevel surface 48, 49 co-extensive with each pole face. Each pole face bevel surface abuts an opposite bevel surface of an adjacent bar magnet so that the magnets fit together about the faceted portion of the duct to define a tunnel through which the duct extends. By the configuration described the end surface 51 on each side of a magnet is reduced and the fringing field normally flowing therefrom is considerably reduced. The magnet configuration, as demonstrated by the broken lines 52 (FIG. 4) results in focused magnetic fields so that there is no need for added-on electrical equipment to generate electrical fields, as in prior art patents, to effect ion modification.

After the sub-assembly 13 of duct and magnets is prepared, bands or adhesive compatible with the chosen encapsulating material are applied to retain the magnet-duct orientation while the sub-assembly is placed in a molding device, like an injection molding machine, and the molded casing 12 is applied, leaving attachment ends with the beads 15 protruding from the integral end caps 54 of the casing 12.

While polypropylene is preferred as an encapsulating material, the invention does not preclude the use of other dielectric materials for the casing compatible with the environment in which the modifier of the invention will be used.

In the embodiment of FIG. 5 a sub-assembly like that of FIG. 3 is encapsulated in a dielectric material in the same manner as the embodiment of FIG. 1 except that the outer configuration of the casing 55 is prismatic instead of cylindrical. Casing 55 has three outer faces 57, 58 and 59 parallel respectively to remote pole faces 34, 38 and 43, resulting in a triangular corss-sectional shape. The shape of the embodiment of FIG. 5 uses less encapsulating material and may be easier to accommodate to certain installation conditions.

Both embodiments offer the advantages of superior focussing of magnetic fields, elimination of a fringing field effect between the magnet operating areas and self insulating design. In addition, the present invention affords leakproof, free-flowing fuel duct design in a device capable of construction in any size in an extremely economical unit. With the three-faceted duct portion the magnet poles are in close proximity to the ducted fuel.

While other embodiments may occur to those skilled in this particular art other than those disclosed herein to typify the invention, the appended claims define the invention which the disclosure is merely illustrative of.

I claim:

1. A liquid fuel ion modifier for use between a fuel supply and a fuel consuming device and comprising a fuel delivery duct, conduit attachment means at opposite ends of said duct, a plurality of bar magnets secured about said delivery duct, an intermediate delivery duct portion having a plurality of outer facets equal in number to the plurality of magnets, a like magnetic pole of a magnet being adjacent each delivery duct portion facet the magnets each having a pole face co-extensive along said delivery duct with pole faces of other magnets of said plurality of magnets, each magnet further having an edge bevel surface in contact with an edge bevel surface of each adjacent magnet of said plurality to define a magnet tunnel through which said delivery duct intermediate portion extends.

2. A fuel modifier in accordance with claim 1 wherein said plurality of magnets and said intermediate delivery duct portion are encapsulated within a molded casing of a dielectric material.

3. A fuel modifier in accordance with claim 1 wherein said delivery duct portion comprises three wall facets defining a duct of triangular crosssection and surrounded by three bar magnets.

4. A fuel modifier in accordance with claim 3 wherein said casing is prismatic in outer configuration.

5. A fuel modifier in accordance with claim 3 wherein said casing is cylindrical in outer configuration.

6. A liquid fuel ion modifier for use between a fuel supply and a fuel consuming apparatus each having fuel conducting conduit means and comprising a fuel delivery duct of non-magnetic material, conduit attachment means at opposite ends of said duct, a plurality of bar magnets secured about said delivery duct, an intermediate delivery duct portion having a plurality of outer facets equal in number to the plurality of magnets and transparent to magnetic flux lines, a like pole of each magnet being adjacent each delivery duct facet, each magnet having a pole face co-extensive along said duct intermediate portion with pole faces of other magnets, an edge bevel surface on each magnet in contact with an edge bevel surface of each adjacent magnet to define a magnet tunnel through which said delivery duct intermediate portion extends, and a molded casing encapsulating said plurality of magnets and said delivery duct intermediate portion so as to fix said magnets with respect to said duct facets and to each other.

7. A fuel modifier in accordance with claim 6 wherein said delivery duct portion has three facets defining a duct portion of triangular transverse crosssection with each facet adjacent a like pole of one of three magnets.

8. A fuel modifier in accordance with claim 6 wherein said casing is prismatic in outer configuration.

9. A fuel modifier in accordance with claim 6 wherein said casing is cylindrical in outer configuration.

* * * * *